US006663428B1

(12) United States Patent
Wu

(10) Patent No.: US 6,663,428 B1
(45) Date of Patent: Dec. 16, 2003

(54) ELECTRICAL CONNECTOR WITH IMPROVED GROUNDING TERMINAL ARRANGEMENT

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/215,528

(22) Filed: Aug. 9, 2002

(51) Int. Cl.[7] ..... H01R 13/648

(52) U.S. Cl. ..... 439/608; 439/108; 439/76.1; 439/906

(58) Field of Search ..... 439/108, 608, 439/637, 76.1, 686, 687, 660, 696, 906, 79

(56) References Cited

U.S. PATENT DOCUMENTS 5,295,843 A * 3/1994 Davis et al. ..... 439/108
5,618,191 A * 4/1997 Chikano et al. ..... 439/108
5,853,303 A * 12/1998 Brunker et al. ..... 439/637
5,920,459 A * 7/1999 Weber et al. ..... 439/346
6,146,205 A * 11/2000 Lai ..... 439/610
6,183,302 B1 2/2001 Daikuhara et al.
6,290,515 B1 * 9/2001 Lee ..... 439/608
6,419,502 B1 7/2002 Trammel
6,589,066 B1 * 7/2003 Wu ..... 439/352

* cited by examiner

*Primary Examiner*—P. Austin Bradley
*Assistant Examiner*—Briggitte R. Hammond
(74) *Attorney, Agent, or Firm*—Wei Te Chung

(57) ABSTRACT

An electrical connector (1) comprises an upper housing (2), a bottom housing (3) and a terminal module (4). The upper housing and the bottom housing together define a space and a mating port (20) positioned near the space. The terminal module has a base (40), a tongue (41) extending in the mating port from the base in a mating direction, and a plurality of signal terminals (7, 8) and grounding terminals (5, 6) therein. The signal terminals are disposed opposite sides of the tongue in pairs. A square hole (418) is formed in the tongue and aligned with every two opposite signal terminals.

12 Claims, 7 Drawing Sheets

ELECTRICAL CONNECTOR WITH IMPROVED GROUNDING TERMINAL ARRANGEMENT

CROSS-REFERENCE TO RELATED APPLICATIONS

This patent application is related to U.S. Pat. No. 6,589,066 filed Jul. 30, 2002, titled "ELECTRICAL CONNECTOR HAVING LATCHING MECHANISM", both of which assigned to the common assignee and which are hereby fully incorporated by reference.

BACKGROUND OF THE INVENTION

1. Field of the Invention

The present invention relates to an electrical connector, and in particular to an electrical connector which provides suitable impedance for balanced transmission.

2. Description of Related Art

With the development of communication and computer technology, high density electrical connectors with conductive elements in a matrix arrangement are desired to construct a large number of signal transmitting paths between two electronic devices. Such high density electrical connectors are widely used in internal connecting systems of severs, routers and the like devices requiring high speed data processing and communication.

U.S. Pat. No. 6,183,302 issued to Osamu Daikuhara et al. and on Feb. 6, 2001 discloses a high density connector which includes a dielectric housing, a plurality of signal and grounding contacts alternately disposed in the dielectric housing, wherein the first and second signal contacts can provide about 50 Ω impedance. However, in this way, the impedance of each signal contact cannot be accurately controlled in a suitable range. Specially, in differential pair technique, the steady impedance is the key to balanced transmission. By the way, the differential pair of technique means that a signal is transmitted via two paths, wherein each path has the same length as the other path. Furthermore, even we can improve impedance function of the signal contacts via modifying shape or size of the signal contacts, but these methods are wasteful, which cannot be easily used in any condition, specially for some connectors having definite standard.

It is thus desirable to provide an electrical connector which can resolve above problem in prior art.

SUMMARY OF THE INVENTION

Accordingly, an object of the present invention is to provide an electrical connector which can satisfy the impedance needs of application.

In order to achieve the object set forth, an electrical connector in accordance with the present invention comprises an upper housing, a bottom housing and a terminal module. The upper housing and the bottom housing together define a space and a mating port positioned near the space. The terminal module has a base, a tongue extending in the mating port from the base, and a plurality of signal and grounding terminals therein. The signal terminals are disposed opposite sides of the tongue in pairs. A square hole is formed in the tongue and parallel to the signal terminals.

Furt hermore, the tongue defines a plurality of through grooves and grooves arranged alternately to each other. The terminal module may comprise a circuit board for engaging with the first grounding terminals and signal terminals. The grounding terminals consist of first grounding terminals for engaging with a mating connector and second grounding terminals for shielding the signal terminal.

Other objects, advantages and novel features of the invention will become more apparent from the following detailed description when taken in conjunction with the accompanying drawings.

DETAILED DESCRIPTION OF THE INVENTION

Figure 1:
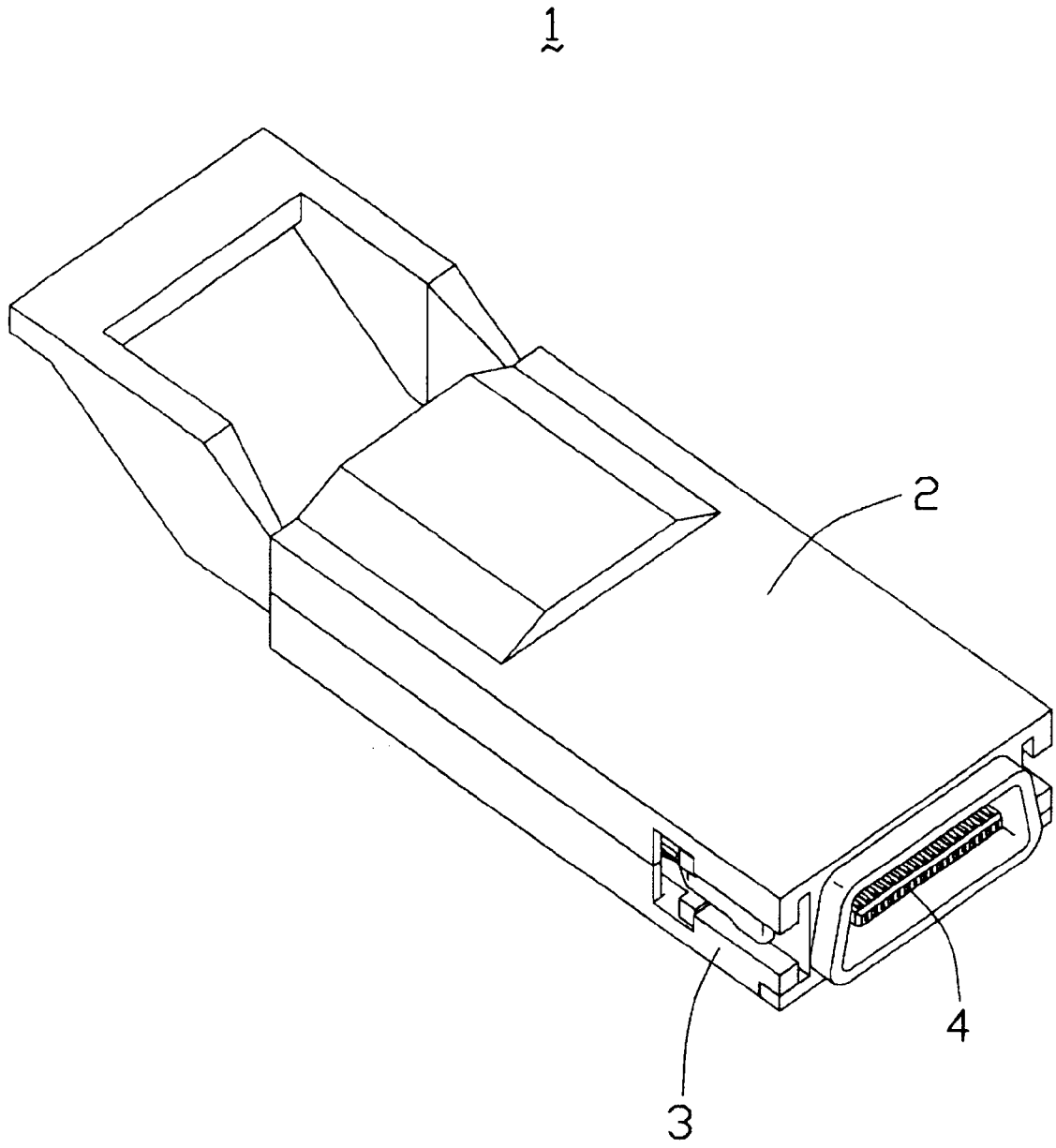
FIG. 1 is a perspective view of an electrical connector in accordance with the present invention.
Figure 2:
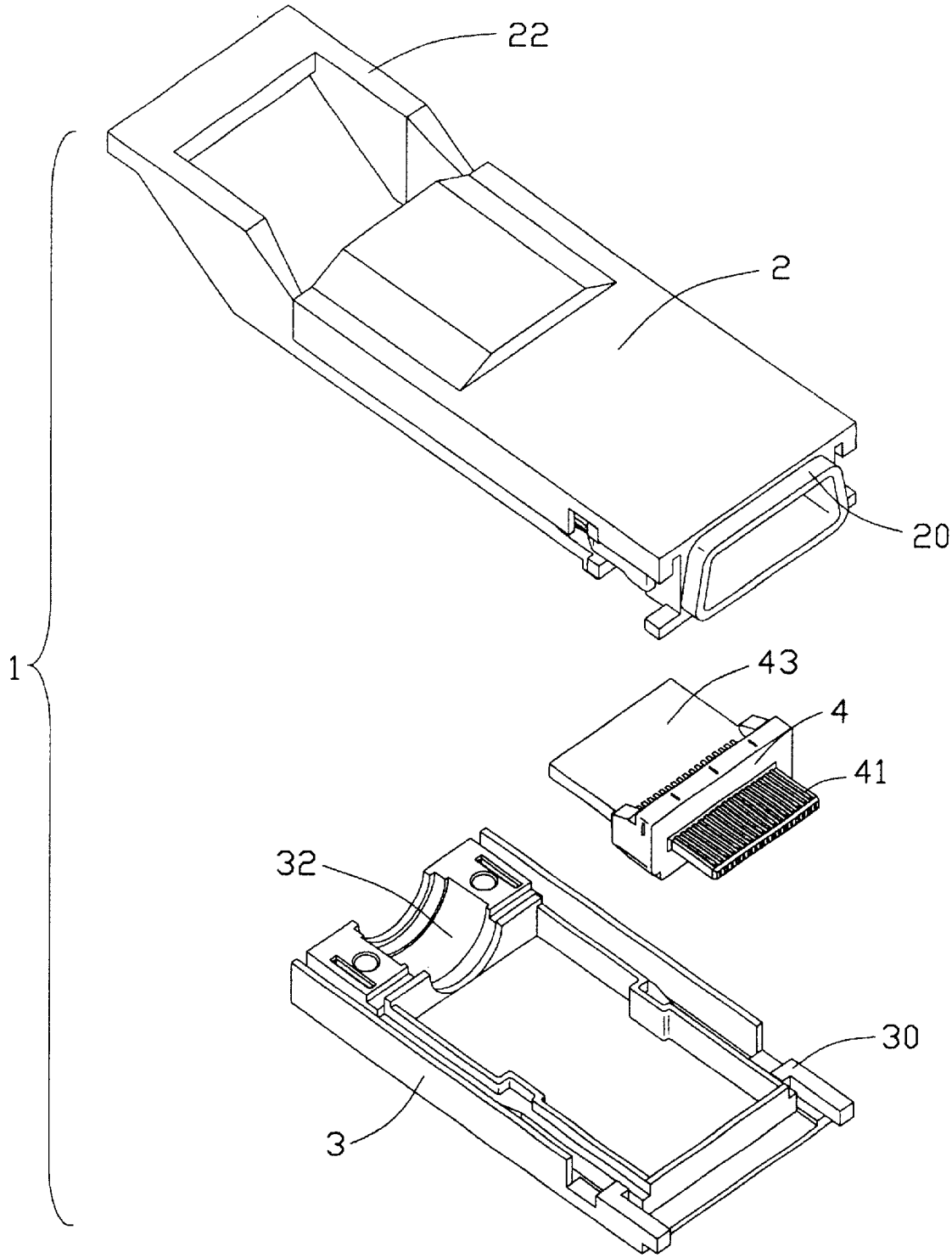
FIG. 2 is an exploded view of the electrical connector shown in FIG. 1.

Referring to FIGS. 1 and 2, an electrical connector 1 in accordance with the present invention comprises an upper housing 2, a bottom housing 3, and a terminal module 4 located between the upper and bottom housings 2 and 3. The upper housing 2 defines a mating port 20 and a push bar 22 at opposite ends thereof. The bottom housing 3 defines an ejector mechanism 30 for retention of a complement connector (not shown), and an opening 32 for extension of a cable at rear portion thereof.

Figure 3:
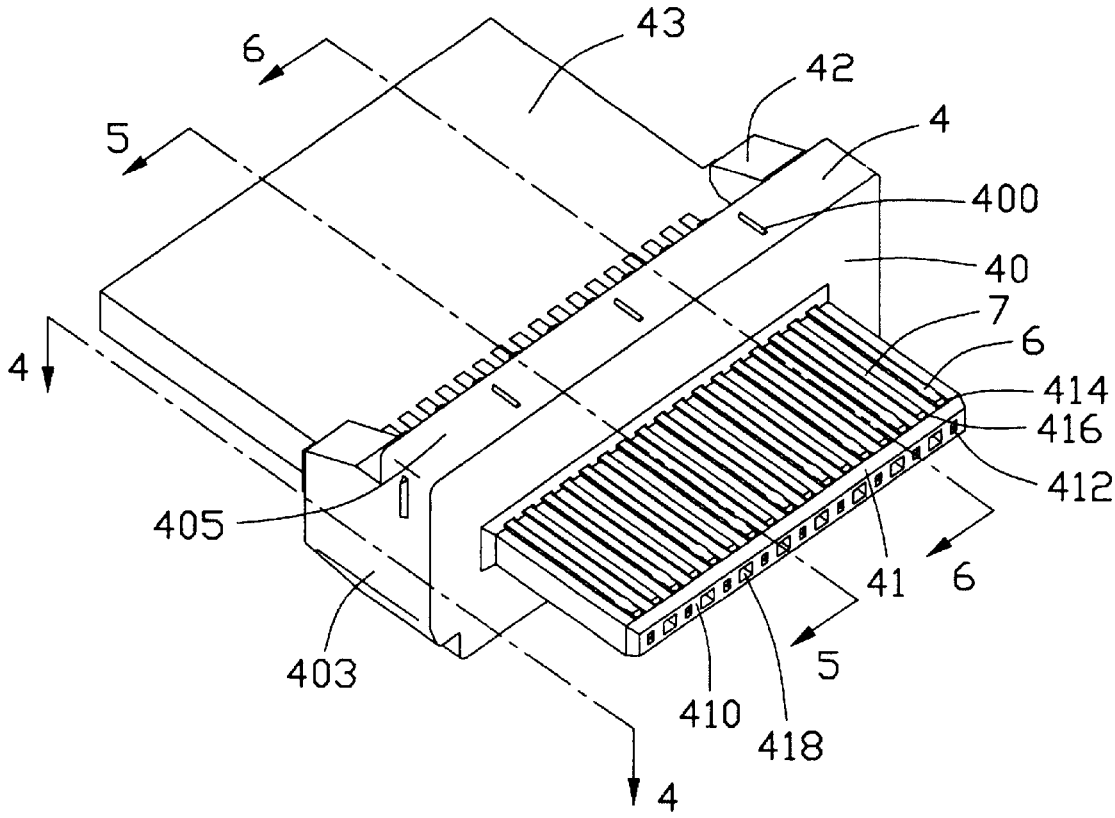
FIG. 3 is a perspective view of a terminal module of the connector with a circuit board removed from the terminal module to facilitate the illustration.
Figure 4:
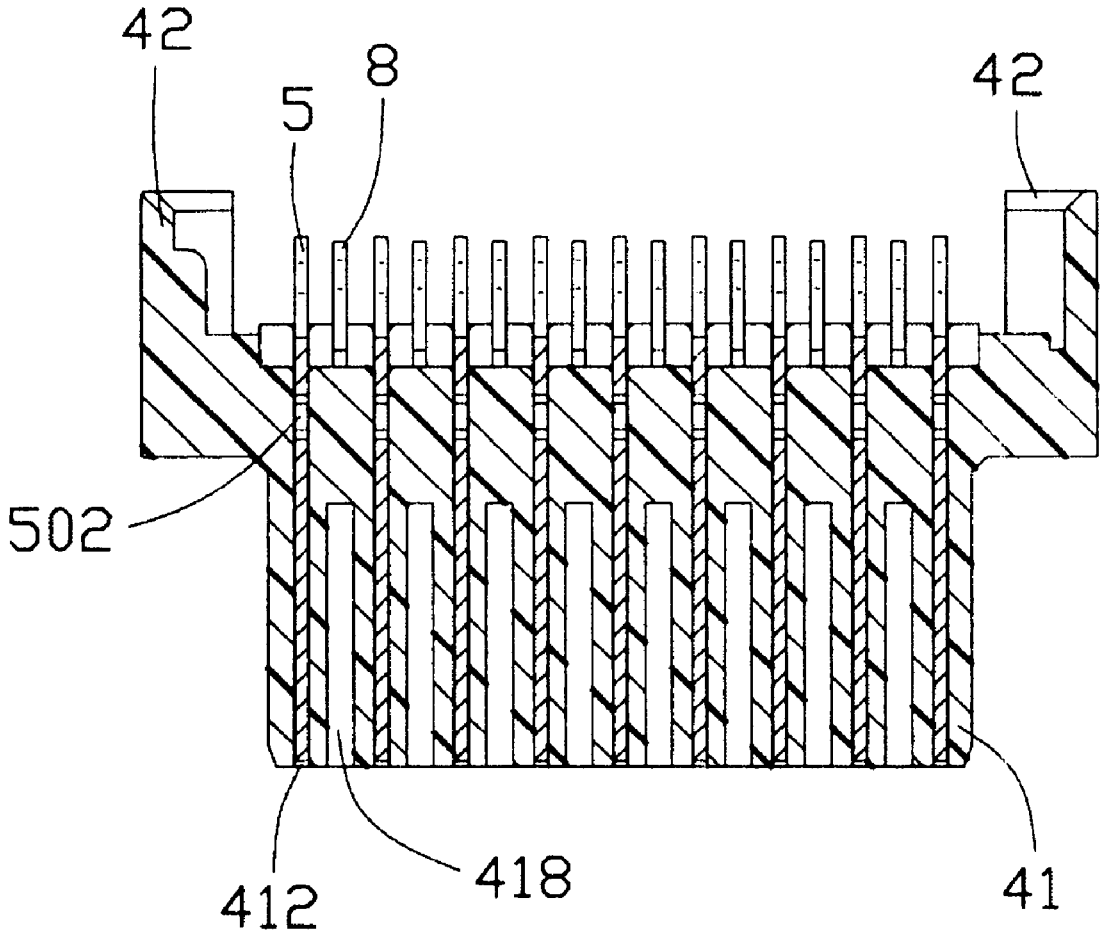
FIG. 4 is a cross-sectional view of FIG. 3 taken along line 4—4 of FIG. 3.

Referring to FIGS. 3 and 4, the terminal module 4 comprises a base 400, a tongue 41 projecting forward from the base 400 for mating, a pair of leading arms 42 extending from both sides of the base 400 and an inner circuit board 43 (FIG. 2) disposed between the pair of leading arms 42 and adjacent to rear portion of the base 40. The base 400 forms a plurality of protrusions 400 beyond two sidewalls 403 and an upper surface 405 thereof, and a pair of ribs 401 extending rearward from the base 400. The ribs 401 further define a rear surface 402 facing the circuit board 43. The tongue 41 defines a front surface 410 parallel to the rear surface 402 and facing to the complement connector. A plurality of through grooves 414 are defines in the tongue 41, and a plurality of grooves 416 are formed between every two adjacent through grooves 414 and positioned at both side of the tongue 41 in pairs. In addition, the tongue 41 has a plurality of square holes 418 between every pair grooves 416, wherein the square holes 418 not extend into the base 40. In this preferable embodiment, each square hole 418 is aligned with a pair of grooves 416, but the hole 418 needn't always be aligned with the pair of grooves 416. Generally, the terminal module is mold in plastics, which has better insulative than the air. Thus, whole impedance of the connector 1 molded mainly by plastics cannot meet with serious signal transmission in high speed and high density condition. While via the square holes 418, there are filled with air, which has better electrical conductivity to ensure balanced impedance. In other words, due to providing square holes 418 in the terminal module 4, the whole impedance of the connector 1 is controlled in a rational range.

Figure 5:
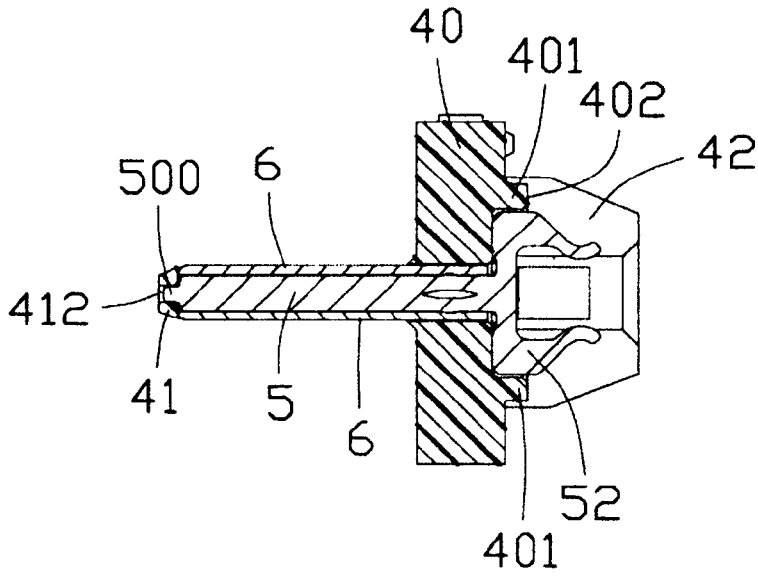
FIG. 5 is a cross-sectional view of FIG. 3 taken along line 5—5.
Figure 6:
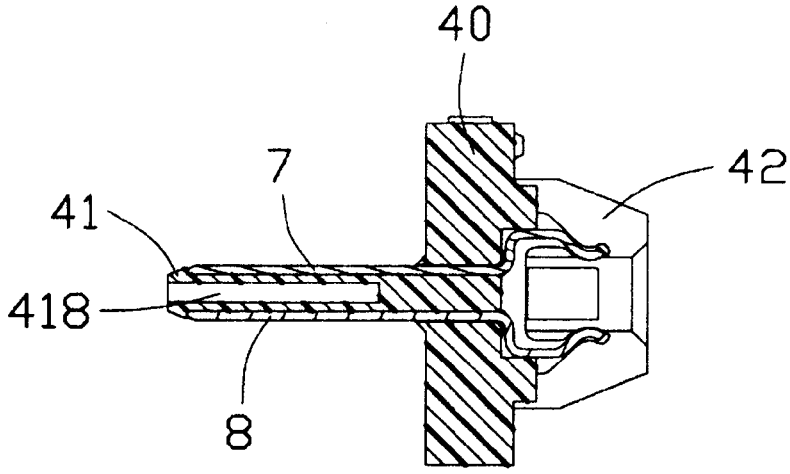
FIG. 6 is a cross-sectional view similar to FIG. 5 but taken along line 6—6 of FIG. 3.
Figure 7:
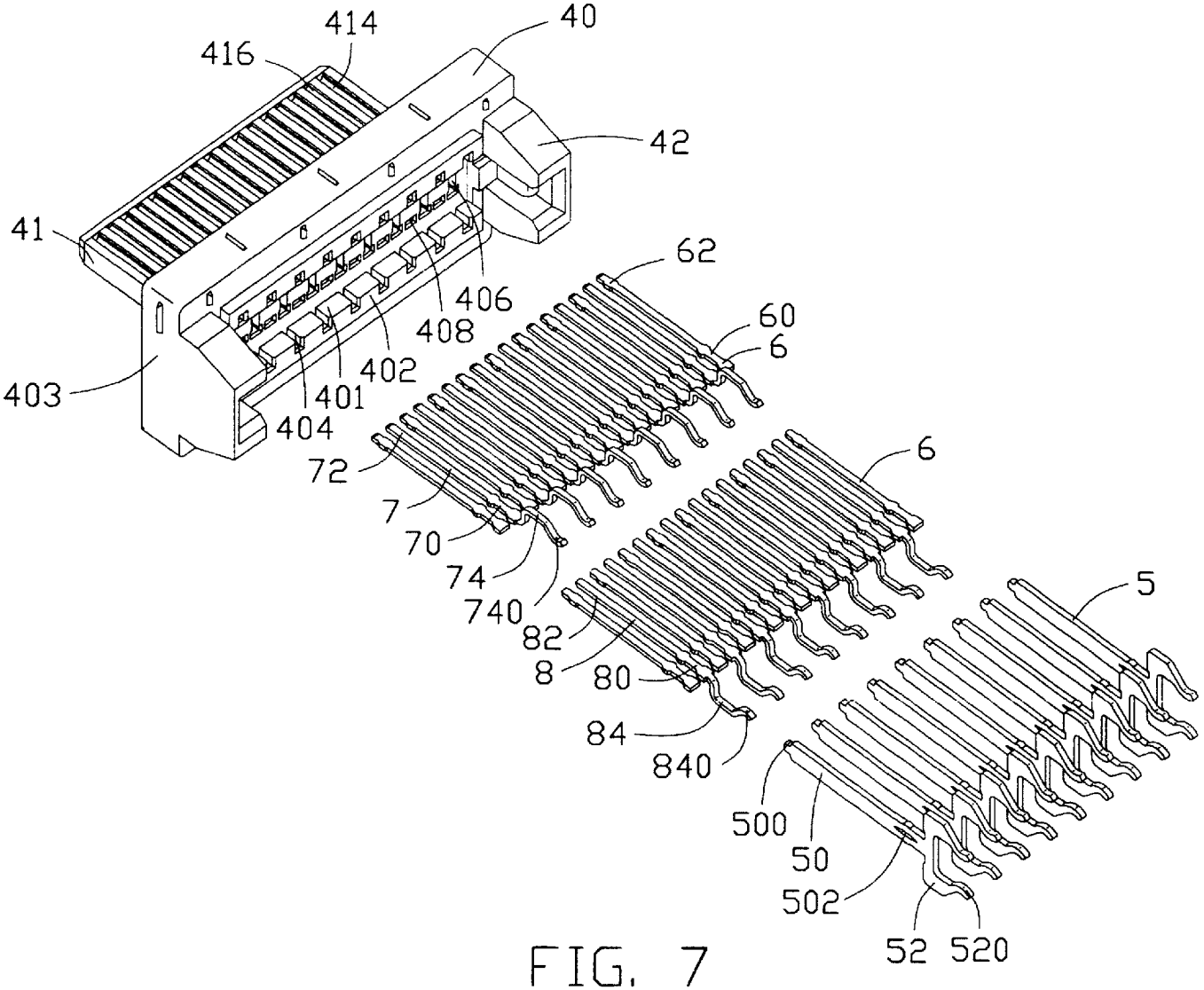
FIG. 7 is an exploded view of the terminal module shown in FIG. 3.

Referring to FIGS. 5–7, each rib 401 forms a plurality of recesses 404. A plurality of passageways 406 is formed through the base 40 and communicates with corresponding through grooves 414. A plurality of passages 408 are formed through the base 40 and each communicates with a corresponding groove 416. Specially, each recess 404 is aligned with a corresponding passageway 406 in a vertical direction. Each passageway 406 has a smaller width at middle portion and has bigger width at both ends thereof. Furthermore, the tongue 41 defines a plurality of holes 412 to provide each through groove 414 an opening to the front surface 410. The through grooves 414 and the passageways 406 together define a terminal-receiving space for receiving grounding terminals, and the grooves 416 and passages 408 together define a contact-receiving space for receiving signal terminals.

A plurality of terminals are received in the terminal module 4 and divided into first grounding terminals 5, second grounding terminals 6, first signal terminals 7 and second signal terminals 8. Referring to FIG. 7 please, each first grounding terminal 5 includes a limb 50 and a pair of wings 52 extending from an end of the limb 50. At opposite ends of the limb 50, there defines a tip 500 to cooperate with the hole 412 and a needle hole 502 to create flexible contact force, respectively. Each wing 52 defines an engaging portion 520. Each second grounding terminal 6 includes a retention portion 60 for retaining the terminal 6 in the terminal module 4, and a contact portion 62 for engaging the circuit board 43. Each first signal terminal 7 includes a retention portion 70, and a contact portion 72 and a curved portion 74 extending in opposite directions and from the retention portion 70. The curved portion 74 further defines an engaging portion 740 for connecting the circuit board 43. Each second signal terminal 8 includes a retention portion 80, and a contact portion 82 and a curved portion 84 extending in opposite directions and from the retention portion 80. The curved portion 84 further defines an engaging portion 840 for connecting the circuit board 43. In addition, the length of the second grounding terminals 6 is equal to the length of the retention portion plus the contact portion of each first and second signal terminal 7 and 8. Furthermore, in assembly, the contact portion of the second grounding terminals 6 and the first and second signal terminals 7, 8 has flat shape and is parallel to the upper surface 405 of the base 40, while the limb 50 of the first grounding terminals 5 has also flat shape but being arranged perpendicular to the upper surface 405 of the base 40.

Figure 8:
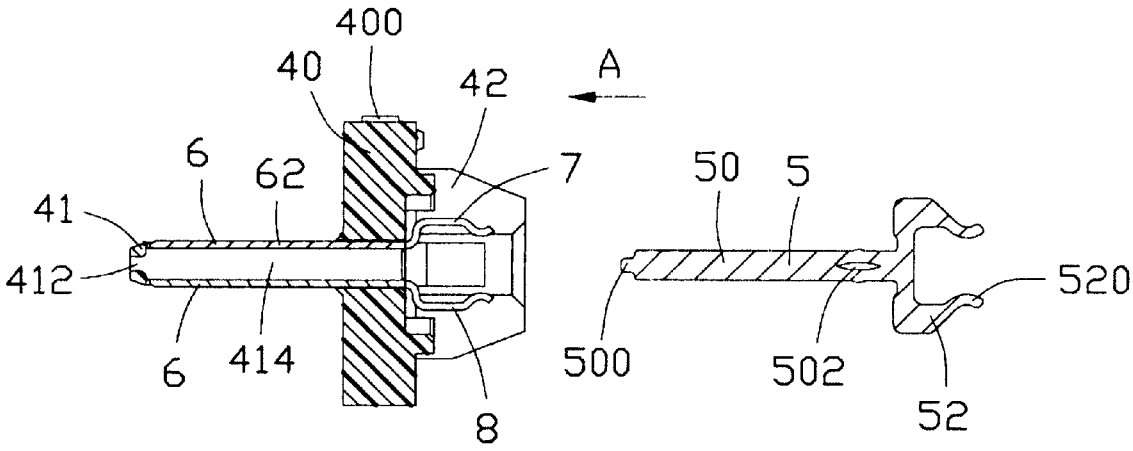
FIG. 8 is a perspective view of the terminal module with grounding terminals about to be inserted into the module.

Referring back to FIGS. 5 and 6 in conjunction with FIG. 8, in assembly, the second grounding terminals 6 are firstly inserted into the passageways 406 of the base 40 and further entirely in the through grooves 414 of the tongue 41 in pairs. The first and second signal terminals 7 and 8 are inserted into passages 408 of the base 40 and further in the grooves 416 of the tongue 41. The flat contact portions 62, 72 and 82 are arranged in both side of the tongue 41 thereby providing enough surfaces for mating with the complement connector. Subsequently, the first grounding terminals 5 are inserted into the passageways 406 of the base 40 in the direction of arrow "A" which represents the "insertion direction" of the terminals, and further into the through grooves 414 until the tip 500 extends into corresponding hole 412 of the tongue 41, wherein the limb 50 engages every adjacent pair of first grounding terminals 5 and the wings 52 are retained in the recesses 404 to prevent unnecessary deformation. Specially, the needle hole 502 provides flexible contact force between the first and second grounding terminals 5, 6. Then the wings 52 of the second grounding terminals 5, and the curved portions 74 and 84 of the first and second signal terminals 7 and 8 are disposed in the receiving cavity 403 of the base 40 and beyond the rear surface 402. Thus, the circuit board 43 (FIG. 2) can be retained between the pair of leading arms 42, and between the wings 52 and the curved portions 74 and 84 via interfering with the engaging portions 520, 740 and 840. In addition, along with insertion direction and perpendicular to the upper surface 405, the wings 50 each has bigger surface relative to the curved portions 74 and 84 thereby providing better grounding protection for signal transmission.

Referring back to FIGS. 1 and 2, the terminal module 4 is entirely received in a space defined by the upper and bottom housings 2 and 3, wherein the tongue 41 extends in the mating port 20. The ejector mechanism 30 provides a way to exit the complement connector. A cable (not shown) can extend through the opening 32 and further contact with the circuit board 3 of the terminal module 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a bottom housing;

an upper housing assembled to the bottom housing together to define a space and a mating port positioned near the space; and a terminal module received in the space defined by the upper and bottom housings, the module having a base, a tongue extending in the mating port from the base, and a plurality of signal terminals and grounding buses therein, said signal terminals being disposed opposite sides of the tongue in pairs, a plurality of holes being formed in the tongue and parallel to said signal terminals, wherein the grounding buses consist of first grounding terminals for engaging with a mating connector and second grounding terminals for shielding the signal terminals and every first grounding terminal and two corresponding second grounding terminals are received in a same passageway of the base and wherein the terminal module further comprises a circuit board for engaging with the second grounding terminals and signal terminals.

2. The electrical connector as claimed in claim 1, wherein the base defines a plurality of recess at a portion which is against the mating direction for retention of the second grounding terminals.

3. The electrical connector as claimed in claim 1, wherein both the first grounding terminals and signal terminals have flat surface for reliable engagement with a complement connector.

4. The electrical connector as claimed in claim 1, wherein each hole is aligned with every pair of signal terminals.

5. The electrical connector as claimed in claim 1, wherein the tongue defines a plurality of through grooves and grooves for respective receipt of the grounding terminals and the signal buses.

6. The electrical connector as claimed in claim 5, wherein the through grooves and the grooves of the tongue are arranged alternately to each other.

7. The electrical connector as claimed in claim 2, wherein each of the first and second grounding terminals defines a contact portion in the tongue and a retention portion in the base.

8. The electrical connector as claimed in claim 7, wherein each second grounding terminal further includes a pair of wings extending outside of the base from the retention portion.

9. The electrical connector as claimed in claim 8, wherein each contact portion of the second grounding terminal defines a tip to operate with the tongue.

10. The electrical connector as claimed in claim 9, wherein the base defines a plurality of passageways communicating with the through grooves to receive grounding terminals, and passages communicating with the grooves to receive grounding terminals.

11. The electrical connector as claimed in claim 1, wherein the retention portion of the second grounding terminals defines a needle hole for providing flexible contact force between the first and second grounding terminals.

12. An electrical connector comprising:

a terminal module including:

a base;

a tongue extending forwardly from the base;

pairs of signal contacts respectively located on two opposite faces of the tongue;

a plurality of first holes rearwardly extending from a front face of the tongue and between the pair of signal contacts, respectively, while not extending through said tongue in a front-to-back direction, for impedance control wherein a plurality of grounding contacts are alternatively arranged with said pair of signal contacts in said tongue and a plurality of second holes are formed in the tongue and the grounding contacts extending thereinto, respectively, from a rear portion of the base.

* * * * *